US007958680B2

(12) United States Patent
DeNooy

(10) Patent No.: US 7,958,680 B2
(45) Date of Patent: Jun. 14, 2011

(54) APPARATUS AND METHOD FOR MANAGING RUNOFF WATER FROM A DOWN SPOUT OF A GUTTER SYSTEM

(76) Inventor: Dennis DeNooy, Barnes City, IA (US)

( * ) Notice: Subject to any disclaimer, the term of this patent is extended or adjusted under 35 U.S.C. 154(b) by 0 days.

(21) Appl. No.: 12/912,084

(22) Filed: Oct. 26, 2010

(65) Prior Publication Data

US 2011/0061758 A1 Mar. 17, 2011

Related U.S. Application Data

(63) Continuation of application No. 11/734,852, filed on Apr. 13, 2007, now abandoned.

(51) Int. Cl.
*E04D 13/00* (2006.01)

(52) U.S. Cl. ..... 52/97; 52/94; 52/16; 52/12

(58) Field of Classification Search ..... 52/16, 94, 52/97, 12, 101; 137/372, 615; 251/126, 251/127; 169/5, 14
See application file for complete search history.

(56) References Cited

U.S. PATENT DOCUMENTS

| | | | | | |
|---|---|---|---|---|---|
| 2,334,779 | A | * | 11/1943 | Luff | 52/97 |
| 4,450,654 | A | * | 5/1984 | Clendenin | 52/12 |
| 5,358,007 | A | * | 10/1994 | Carlberg | 137/615 |
| 5,829,246 | A | * | 11/1998 | Abrams et al. | 60/761 |
| 5,937,908 | A | * | 8/1999 | Inoshiri et al. | 138/39 |
| 6,067,710 | A | * | 5/2000 | Sakaoka et al. | 29/842 |
| 6,076,710 | A | * | 6/2000 | Yates et al. | 222/491 |
| 2008/0138156 | A1 | * | 6/2008 | Janesky | 405/40 |

* cited by examiner

*Primary Examiner* — Brian E Glessner
*Assistant Examiner* — Patrick Maestri
(74) *Attorney, Agent, or Firm* — McKee, Voorhees & Sease, P.L.C.

(57) ABSTRACT

An apparatus and method for connecting to the down spout of a gutter system to slow, disrupt, diffuse and absorb energy from runoff water to thereby eliminate erosion and destruction of surrounding landscaping is beneficial and desirable. The apparatus has an enclosure for passing runoff water therethrough. At least one upwardly extending baffle is used to slow and disrupt water from the down spout and at least one downwardly extending baffle is also used to slow, disrupt and diffuse runoff water from the down spout. The upwardly extending baffle and the downwardly extending baffle are for managing runoff water from the down spout to prevent erosion and destruction of surrounding landscaping.

19 Claims, 10 Drawing Sheets

APPARATUS AND METHOD FOR MANAGING RUNOFF WATER FROM A DOWN SPOUT OF A GUTTER SYSTEM

CROSS-REFERENCE TO RELATED APPLICATIONS

This application is a continuation of U.S. application Ser. No. 11/734,852 filed Apr. 13, 2007, now abandoned, herein incorporated by reference in its entirety.

FIELD OF THE INVENTION

The present invention relates to an apparatus and method for managing runoff water from a down spout of a gutter system. More particularly, the present invention relates to an apparatus and method for preventing streams of runoff water released over top of the surface of the landscaping surrounding a structure from eroding and destroying the landscaping by slowing, disrupting and diffusing the runoff water by passing the runoff water through a body with at least one baffle in fluid communication with the down spout before releasing over top the surrounding landscaping.

BACKGROUND OF THE INVENTION

Management of runoff water from a structure using a gutter system offers many benefits which are commonly known and appreciated. For instance, runoff water may be collected in the gutter system near the roof, carried from the roof to a distribution point below using a down spout and released over top of landscaping adjacent the structure and down spout.

In times past, tiling down runoff water into the sewer system adjacent the structure was acceptable practice. However, more and more regulations are being implemented which require runoff water to be released over top landscaping surrounding the structure. Runoff water released over top of a landscaped surface will continue to erode and destroy the landscaping unless managed by slowing, disrupting and/or diffusing the disruptive stream of runoff water before releasing over top the surface of the landscaping. Therefore, an apparatus and method for managing runoff water from a down spout to prevent uncontrolled streams of water released over top a landscaped surface from eroding and destroying the landscaping surrounding the structure is becoming increasingly important and needed.

Because, an increasing amount of time, money and resources are being invested into beautifying, upgrading and managing the landscaping surrounding a structure, an apparatus and method for preventing runoff water released over the top of the surface adjacent a structure from eroding the landscaping is desired and important.

BRIEF SUMMARY OF THE INVENTION

Therefore, it is a primary object, feature, or advantage of the present invention to improve over the state of the art.

It is a further object, feature, or advantage of the present invention to provide an apparatus and method for managing the destructive and eroding force of runoff water from a down spout of a gutter system.

Yet another object, feature, or advantage of the present invention is to provide an apparatus and method that uses an enclosed body for passing the runoff water through to extract energy from the runoff water by slowing, disrupting and diffusing the runoff water before releasing over top the surrounding landscaping.

A further object, feature, or advantage of the present invention is to provide an apparatus and method that uses at least one baffle or a series of baffles in combination with the body to slow, disrupt and diffuse runoff water to prevent erosion and destruction of surrounding landscaping.

Yet another object, feature, or advantage of the present invention is to provide an apparatus and method that may be flipped up, out of the way, to rest flush against the down spout of the gutter system using the hinge as shown and disclosed in U.S. Pat. No. 5,735,085, the description of which is incorporated herein by reference in its entirety.

A still further object, feature, or advantage of the present invention is to provide an apparatus and method that uses a flexible baffle biased downward on the outlet toward the base to slow and evenly diffuse runoff water across the base of the apparatus.

One or more of these and/or other objects, features, or advantages of the present invention will become apparent from the specification and claims that follow.

According to one aspect of the present invention, an apparatus for connecting to a down spout of a gutter system to slow, diffuse and absorb energy from runoff water to thereby eliminate erosion and destruction of surrounding landscaping is disclosed. The apparatus has a body with an inlet and an outlet and a pair of sidewalls spaced apart and enclosed by a top wall and a bottom wall. A pair of upwardly extending baffles are spaced apart on the bottom wall between the pair of sidewalls. A pair of downwardly extending baffles are on the top wall. A plurality of ribs on the bottom wall are spaced apart and fanned outward to diffuse runoff water moving through the body and away from the outlet. The upwardly extending baffles and the downwardly extending baffles slow, diffuse and absorb energy from runoff water passing through the body to prevent erosion of surrounding landscaping. In the preferred form, one of the downwardly extending baffles is a rubber flap positioned at the outlet and biased against the bottom wall to slow and evenly diffuse runoff water exiting the body. The other downwardly extending baffle is a rigid planar member extending between the pair of sidewalls within the body to deflect some runoff water back upon itself to disrupt and discombobulate runoff water passing through the body. The pair of upwardly extending baffles are offset from each other so a gullet of one baffle is aligned with a tooth of the other baffle to disrupt runoff water flowing through the body.

According to another aspect of the present invention, an apparatus for connecting to a down spout of a gutter system to slow, diffuse and absorb energy from runoff water to thereby eliminate erosion and destruction of surrounding landscaping is disclosed. The apparatus has a tube having a pair of sidewalls spaced apart by a top wall and a bottom wall and an outlet and an inlet adapted to attach to the downspout. A pair of upwardly extending baffles are positioned within the tube on the bottom wall. The pair of upwardly extending baffles are for slowing, diffusing and absorbing energy from runoff water to eliminate erosion and destruction of surrounding landscaping. In the preferred form, a front edge of the top wall at the outlet is angled down toward the bottom wall to redirect some runoff water back upon itself to discombobulate and slow runoff water from the outlet. The pair of teeth on one baffle near the outlet are angled outward toward the pair of sidewalls to diffuse the runoff water flowing out of the outlet. The tube is a gutter elbow fitting for attaching to the down spout of the gutter system. The tube is a gutter extension fitting for attaching to the down spout of the gutter system.

A new method for preventing runoff water from a down spout of a gutter system from eroding surrounding landscaping is disclosed. The method includes providing an open-ended enclosure having at least one baffle within the open-ended enclosure for discombobulating runoff water flowing through the open-ended enclosure. The method also includes introducing runoff water into the enclosure from the down spout, absorbing energy from runoff water within the enclosure using the at least one baffle and slowing runoff water within and upon exiting the enclosure using the at least one baffle to prevent runoff water from eroding surrounding landscaping. In the preferred form, the method also includes the step of redirecting some runoff water back upon itself to discombobulate runoff water passing through the enclosure. The method also includes the step of deflecting some runoff water upward and downward using the at least one baffle and the step of diffusing runoff water using the at least one baffle.

BRIEF DESCRIPTION OF THE DRAWINGS

While the specification concludes with claims particularly pointing out and distinctly claiming the invention, it is believed that the present invention will be better understood from the following description taken into consideration with the accompanying drawings, which:

DETAILED DESCRIPTION OF THE PREFERRED EMBODIMENT

The present invention includes a number of aspects, all of which have broad and far reaching application. One aspect of the present invention relates to an apparatus and method for managing runoff water from a downspout to prevent erosion and the destruction of surrounding landscaping. Another aspect of the present invention relates to an apparatus and method wherein runoff water flowing through the apparatus is slowed, disrupted and diffused before passing over the surrounding landscaping. Although specific embodiments are described herein, the present invention is not limited to these specific embodiments. The present invention contemplates numerous other options in the design and use of the apparatus and method for managing runoff water from the down spout of a gutter system.

Figure 1:
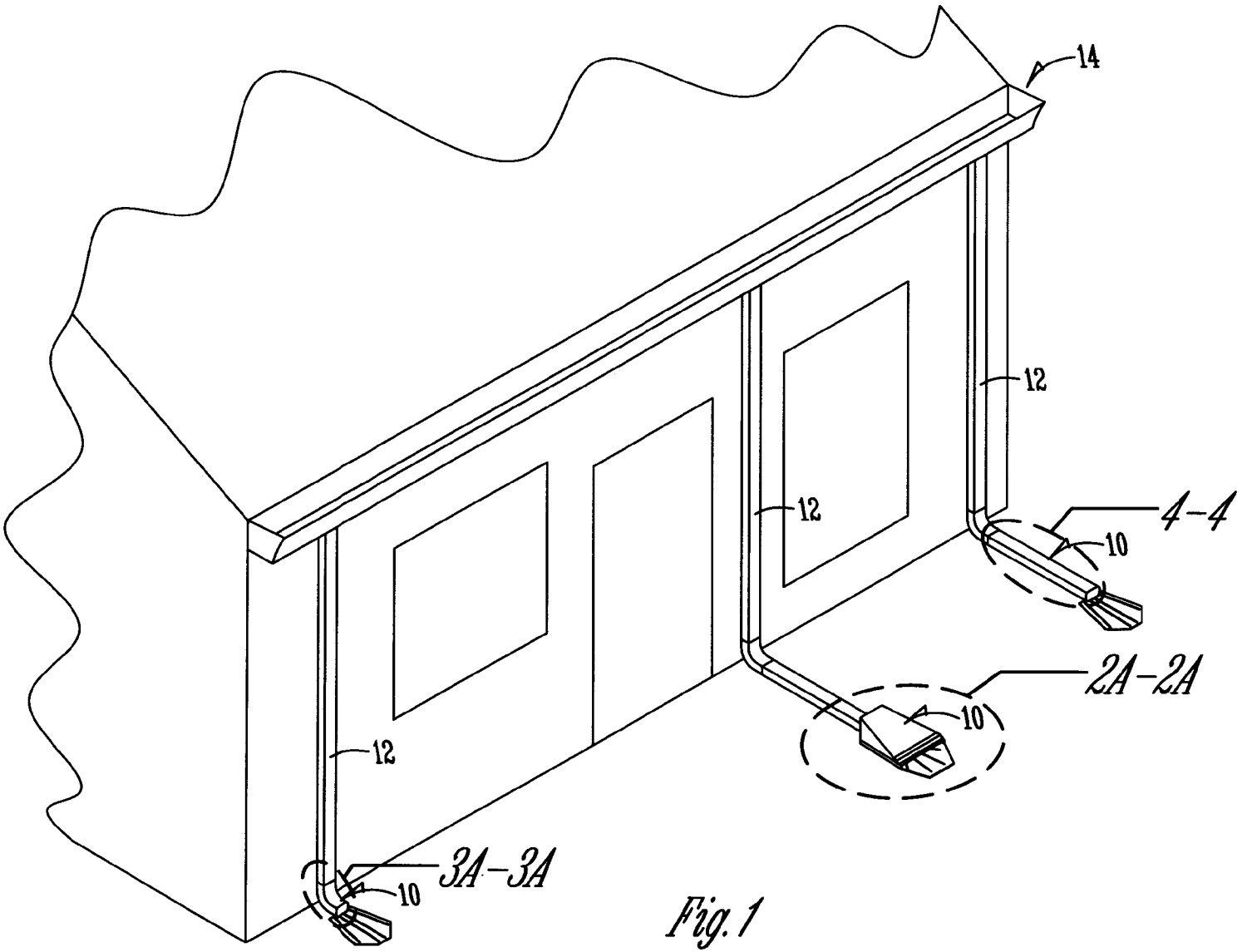
FIG. 1 is a partial isometric view of a structure with a gutter system, down spouts and various embodiments of the apparatus of the present invention.

FIG. 1 is a partial isometric view of a structure with a gutter system, down spouts, and various embodiments of the apparatus according to an exemplary embodiment of the present invention. For example, FIG. 1 shows a gutter system 14 attached to a structure. The gutter system 14 has down spouts 12 for moving runoff water off the structure and onto the surrounding surface near the structure. In one embodiment, the apparatus 10 is an elbow fitting for attaching to the down spout 12. In another embodiment, the apparatus 10 is an extension for attaching to the elbow of the down spout 12. In an additional embodiment, the apparatus 10 is attached to the end of an extension from the down spout 12. Any of the apparatus's 10 shown in FIG. 1 may be used to slow, disrupt and diffuse the flow of runoff water from the gutter system 14 before exiting the down spout 12 onto the surrounding landscaping.

Figure 2A:
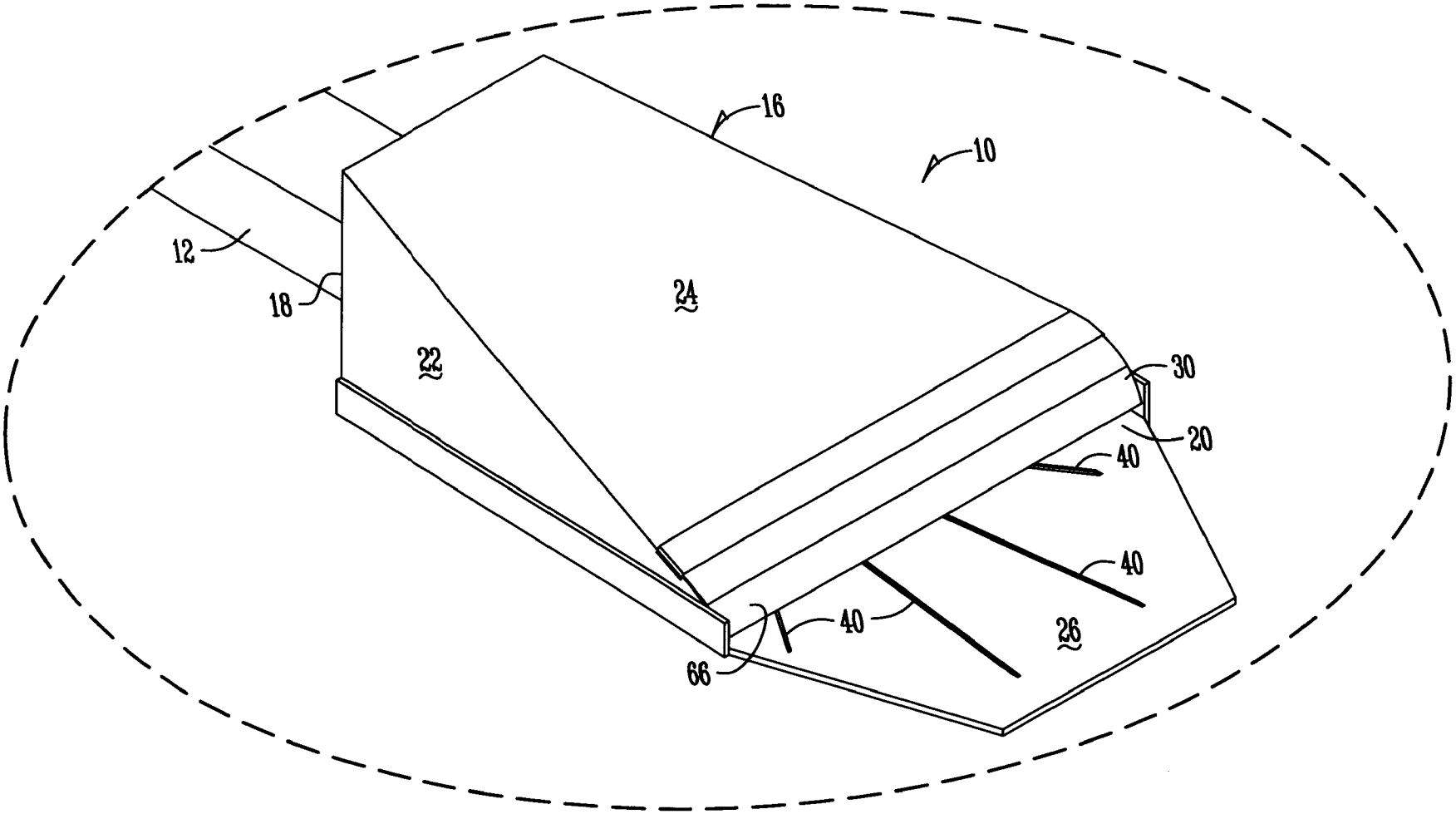
FIG. 2A is an exploded view of the apparatus shown in detail 2A in FIG. 1.

The apparatus 10 as shown in FIG. 2A is an exploded view of the apparatus shown in detail 2A in FIG. 1. The apparatus 10 has a body 16. The body 16 is fully enclosed with the exception of inlet 18 and the outlet 20. The body 16 is formed by a top wall 24 that is spaced apart by sidewalls 22. The body 16 is enclosed by a bottom wall 26. The bottom wall 26 has a plurality of ribs 40 spaced apart and extending in an outwardly direction from the inlet 18 toward the outlet 20. A downwardly extending baffle 30 is positioned at the outlet 20 on the top wall 24 of the body 16. The downwardly extending baffle is preferably constructed of a flexible-type material, such as rubber, plastic or any like material. The downwardly extending baffle 30 is biased toward the bottom wall 26. The body 16 of the apparatus 10 is preferably constructed of a material suitable for handling and passing runoff water, withstanding interrogation by elements external to the body 16 and wears from use. For example, the body 16 may be constructed of a plastic or metal material like the gutter system 14 to resist rust, wear, fatigue and damage due to wear and being unintentionally impacted. The body 16 may be a single molded piece or fabricated from several pieces.

Figure 2B:
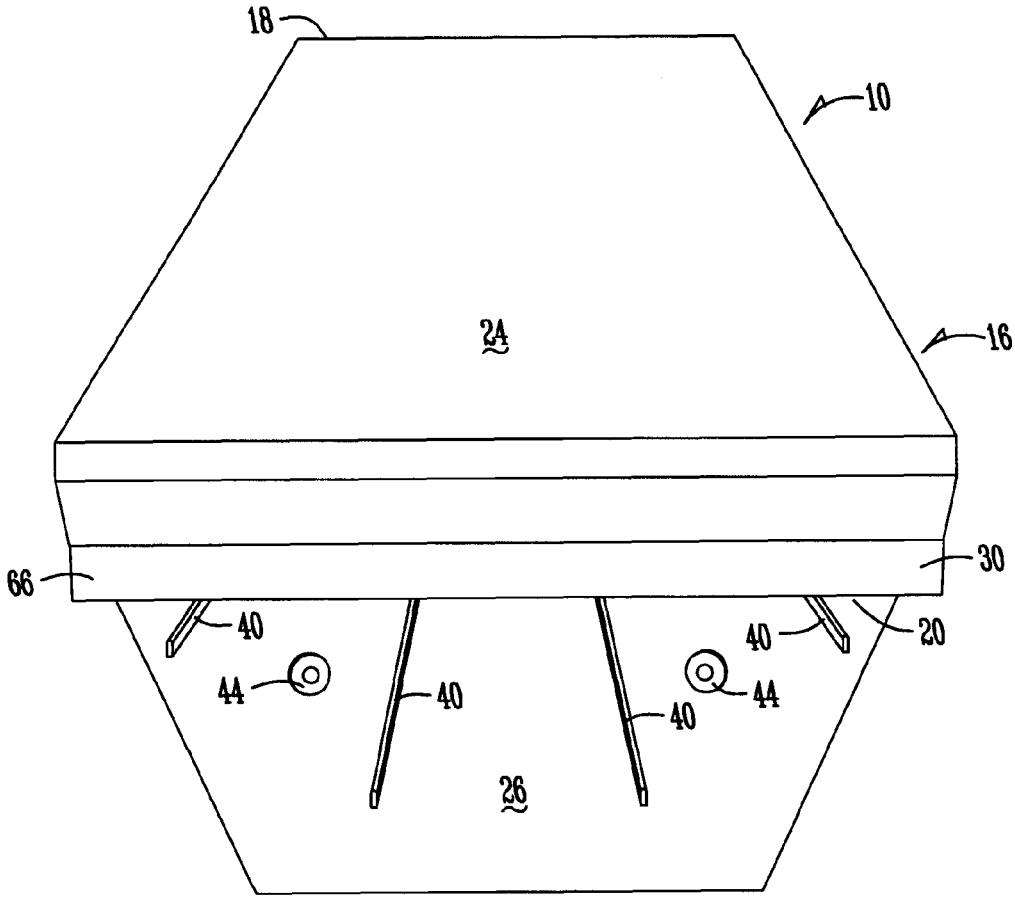
FIG. 2B is a top view of the apparatus according to an exemplary embodiment of the present invention.
Figure 2C:
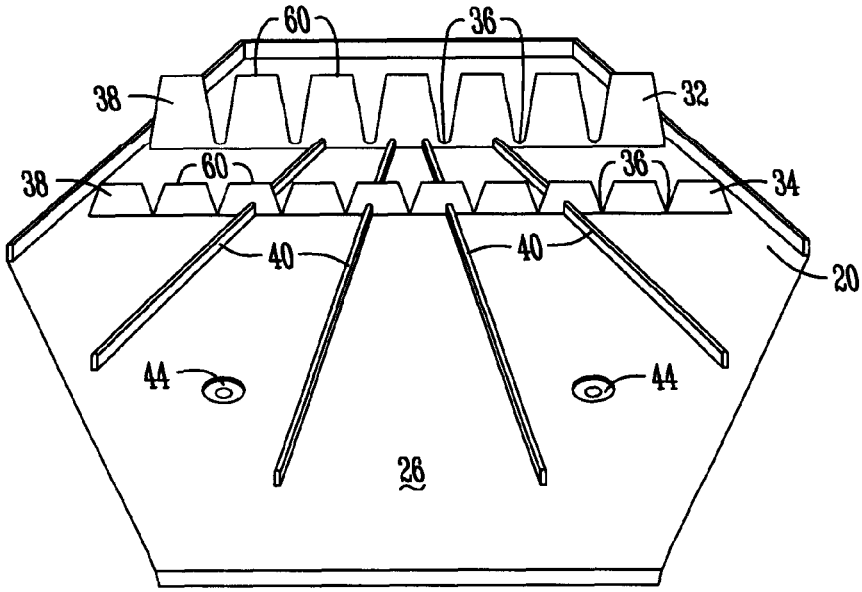
FIG. 2C is a top view of the bottom half of the apparatus according to an exemplary embodiment of the present invention.
Figure 2D:
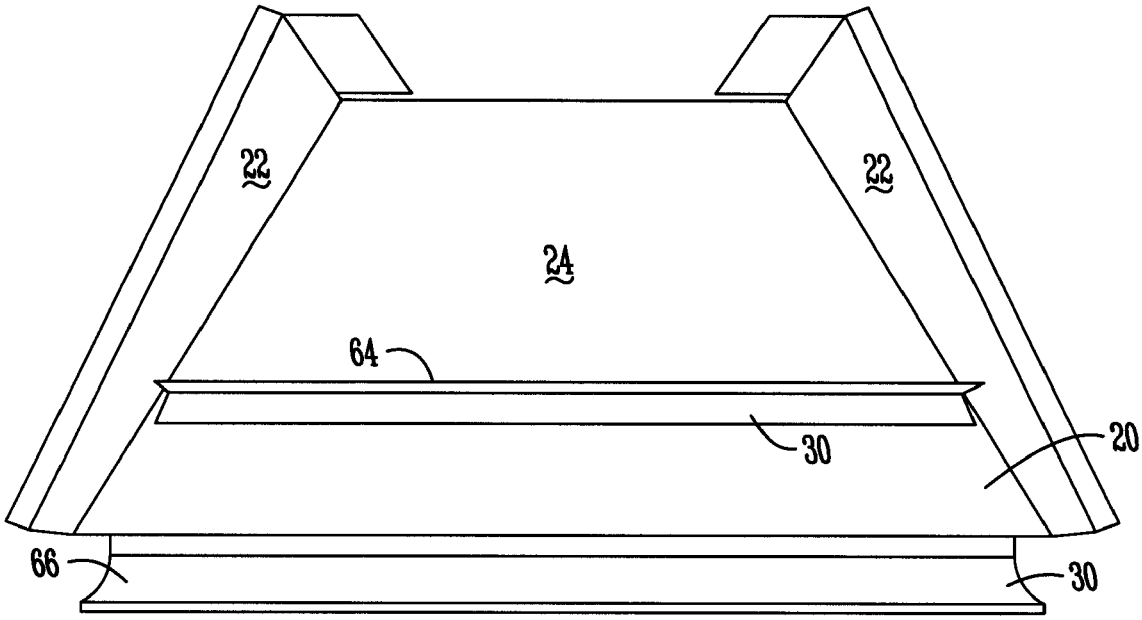
FIG. 2D is an elevated perspective view of the inside of the top half of the of the apparatus according to an exemplary embodiment of the present invention.
Figure 2E:
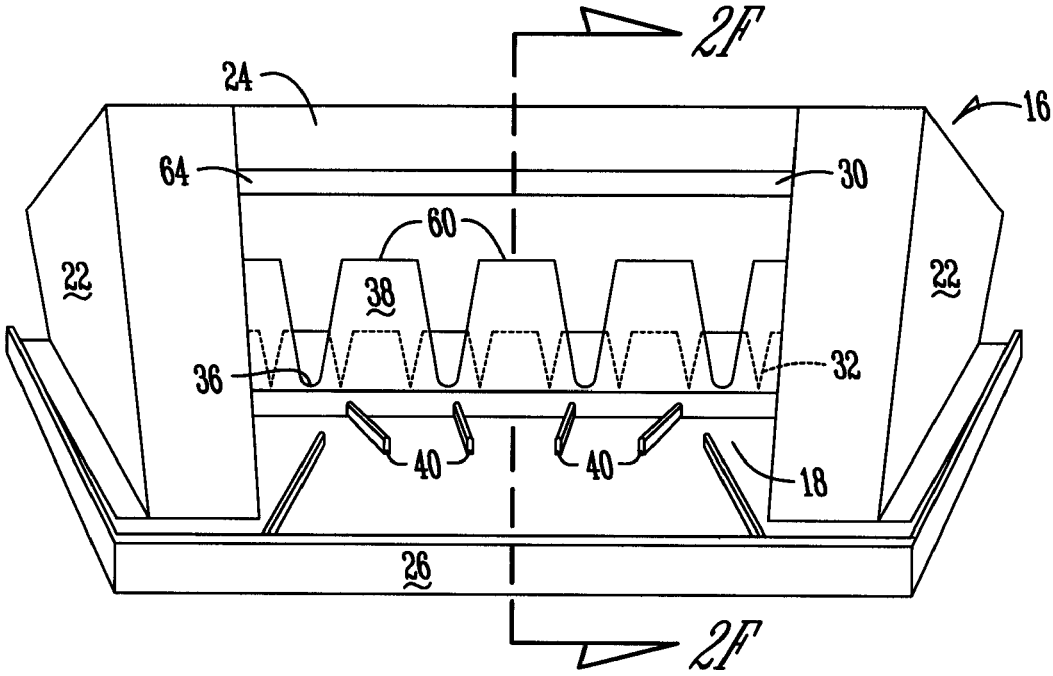
FIG. 2E is a back view of the apparatus according to an exemplary embodiment of the present invention.
Figure 2F:
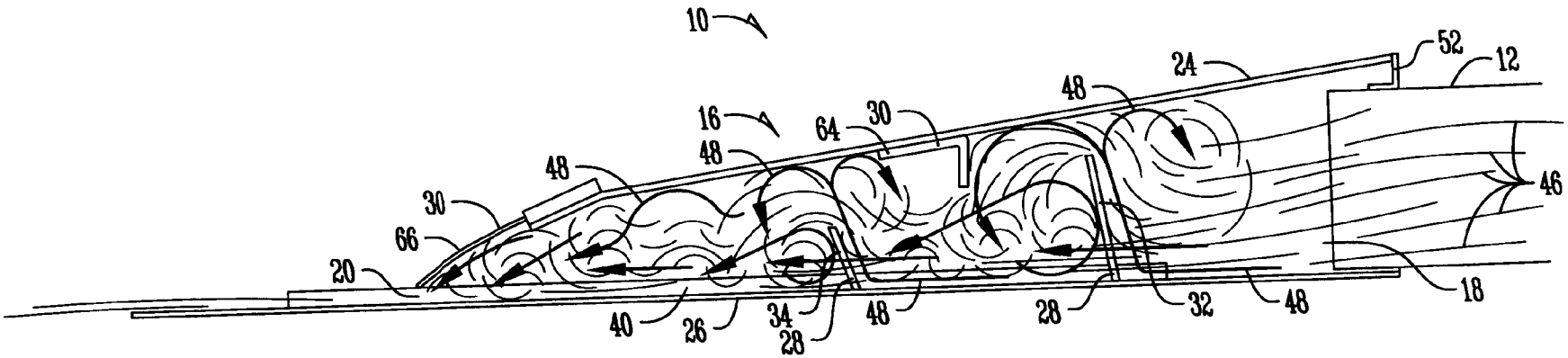
FIG. 2F is a cross-sectional view taken along line 2F-2F in FIG. 2E showing runoff water passing through the apparatus.
Figure 2G:
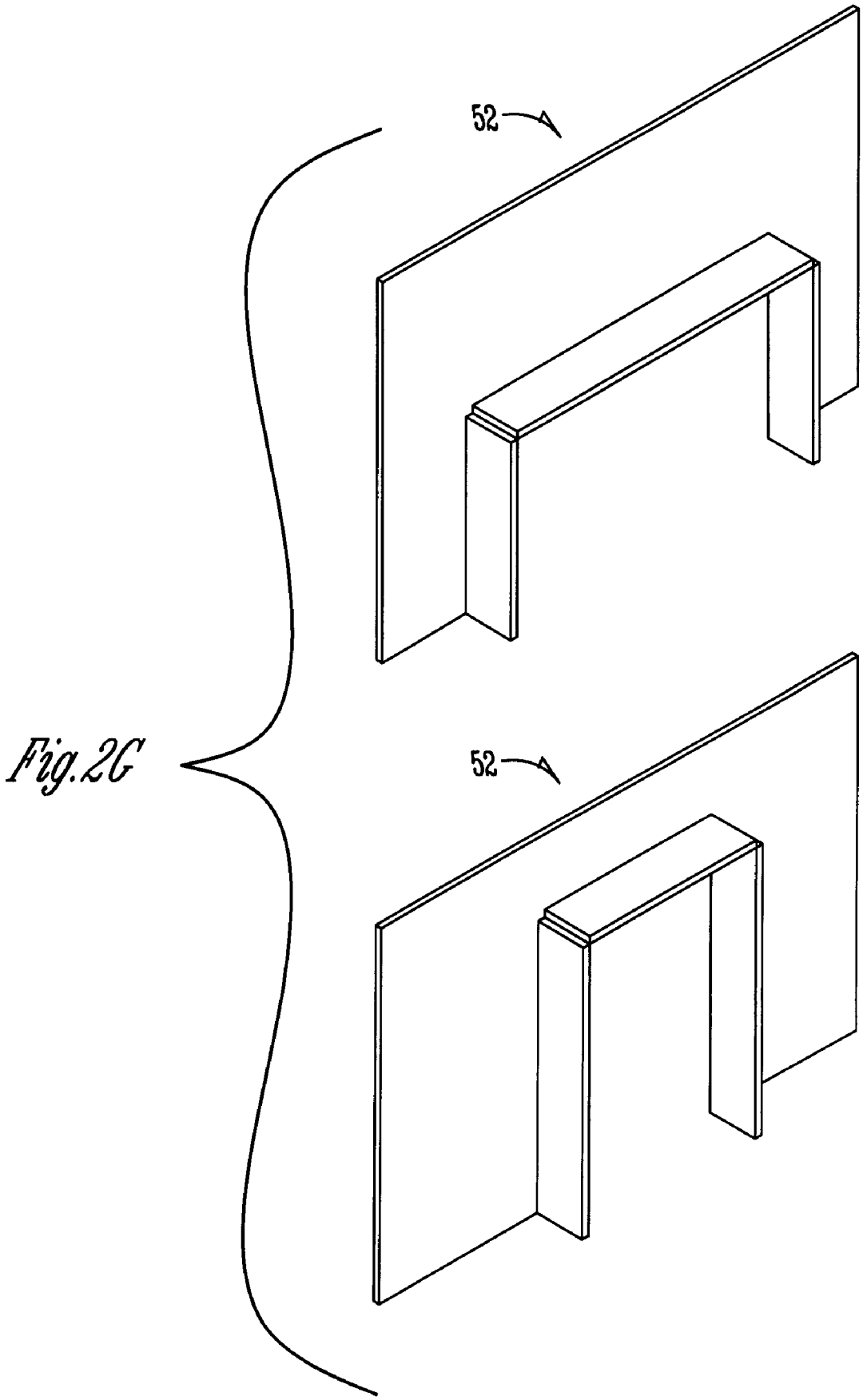
FIG. 2G is an isometric view of a pair of adaptors according to an exemplary embodiment of the present invention.

The inlet 18 of the body 16, as best shown in FIG. 2E, is capable of accommodating one of the adapters 52 shown in FIG. 2G. The adapters 52 mate the down spout 12 to the inlet 18 of the body 16. For example, if the down spout 12 is constructed of B-style gutter or alternatively A-style gutter, the appropriate adapter 52 may be used to ensure that the down spout 12 mates properly with the inlet 18 of the body 16. The top wall 24 of the body 16 tapers downward from the inlet side 18 toward the outlet side 20. Generally speaking, from the inlet 18 to the outlet 20, the body 16 tapers in height and expands in width. Thus, the outlet 20 is longer in width and shorter in height than the inlet 18. However, though the outlet 20 is wider than the inlet 18, the bottom wall 26 preferably tapers to the width of the inlet 18 to the extent the bottom wall 26 extends outward away from the outlet 20 of the body 16. It is understood and appreciated that the bottom wall 26 could be shaped so that the front edge of the bottom wall 26 farthest away from the outlet 20 is wider than the inlet 18 of the body 16.

As best shown in FIG. 2B, the bottom wall 26 may be fitted with apertures 44. Apertures 44 may be used to stake the body 16 of the apparatus 10 to a surface to prevent the body 16 from becoming unattached from the down spout 12, from being moved by the force of runoff water passing through the body 16 or by some unintentional contact with the body 16.

FIG. 2C shows positioned on the bottom wall 26 of the body 16*a* pair of upwardly extending baffles 38, specifically a first baffle 32 and a second baffle 34. The baffle 32, 34 have a gullet 36 spaced between teeth 38. Each tooth 38 ends at its top in a planar surface 60. The gullet 36 between each tooth 38 is preferably shaped in the form of a "V," may be shaped liked a "V" or other shapes best suited for controlling the flow of runoff water. The height of the teeth 38 on the second baffle 34 are less than the height of the teeth 38 on the first baffle 32. It is preferred that each tooth 38 on the second baffle 34 be aligned with a gullet 36 on the first baffle 32, as best illustrated in FIG. 2E and described later in the application. The second baffle 34 is positioned on the bottom wall 26 downstream of the first baffle 32. Also positioned on the bottom wall 26 of the body 16 is a plurality of ribs 40. The ribs 40 are spaced apart and extend outwardly away from each other from the inlet 18 toward the outlet 20. Additional ribs 40 also extend along the edges of the bottom wall 26 near the inlet 18 and extending from the inlet 18 along the outer periphery of the bottom wall 26 toward the outlet 20 to control the flow of runoff water.

FIG. 2D shows a top portion of the body 16. The top portion of the body 16 is formed by sidewalls 22 spaced apart between the top wall 24. Positioned on the top wall 24 is first baffle 64 of the downwardly extending baffles 30. The downwardly extending baffle 30 preferably extends between the pair of sidewalls 22. The first baffle 64 is preferably a planar element constructed of a rigid or semi-rigid material. For example, the first baffle 64 may be constructed of a plastic or some other lightweight inexpensive material capable of withstanding the force of the runoff water passing through the body 16 and the effects of weather and continued exposure to water and moisture. The first baffle 64 is preferably a solid member that is adapted to attach to the top wall 24. The first baffle 64 may be attached to the top wall 24 using various types of fasteners such as a rivet, screw or weld. Alternatively, the first baffle 64 and the top wall 24 may be constructed as a single piece. The first baffle 64 is preferably angled downstream having an obtuse angle with respect to the top wall 24 upstream from the first baffle 64. However, it is further understood that the first baffle 64 may be angled at an acute angle with respect to the top wall 24 depending on the desired deflective behavior. Positioned downstream from the first baffle 64 is a second baffle 66 of the downwardly extending baffles 30. The second baffle 66 is positioned on the outlet side 20 along the top wall 24 of the body 16. The second baffle 66 preferably extends between the sidewalls 22 and away from the outlet side 20. Similar to the first baffle 64, the second baffle 66 may also be attached to the top wall 24 using various types of fasteners, such as a weld, rivet or screw. Alternatively, the top wall 24 and the second baffle 66 may be molded as a single piece.

FIG. 2E shows the inlet 18 of the apparatus 10. The inlet 18 is adapted to receive either one of the adapters 52 shown in FIG. 2G. The adapter 52 is positioned within the inlet 18 so that the down spout 12, whether an extension or elbow piece, may mate properly with the inlet side 18 to close off the inlet 18 to thereby discourage any runoff water from escaping back out of the body 16 through the inlet 18.

FIG. 2F shows the apparatus 10 with the upwardly extending baffles 28 and downwardly extending baffles 30 for slowing, disrupting and diffusing runoff water 46 entering the body 16 through the inlet side 18 and exiting the outlet side 20. In operation, runoff water 46 enters the body 16 through the inlet side 18 from the down spout 12. As the runoff water 46 exits the down spout 12 it approaches the first baffle 32 of the upwardly extending baffles 28. Some of the runoff water 46 comes into contact with teeth 38 on the first baffle 32 and some portion of the runoff water 46 is allowed to pass through a gullet 36 on the first baffle 32 as shown by the flow arrow 48 running parallel to the bottom wall 26. The portion of the runoff water 46 that comes into contact with teeth 38 on the first baffle 32 is deflected in an upwardly direction toward the top wall 24. A portion of this deflected runoff water 46 is thrown back upon runoff water 46 running at, near or along the bottom wall 26 which causes the runoff water 46 to be discombobulated, slowed, and disrupted in its progression through the body 16. Other portions of this deflected runoff water 46 pass over top of the planar top edge 60 of each tooth 38 and is deflected in a downwardly direction back into the runoff water 46 passing along or near the bottom wall 26 as shown by flow arrow 48. As best illustrated by FIG. 2E, the portion of the runoff water 46 that passes through a gullet 36 on the first baffle 32 comes into contact with a tooth 38 on the second baffle 34. This is what was meant when stated earlier that a gullet 36 on the first baffle 32 is preferably aligned with each tooth 38 on the second baffle 34. As shown in FIG. 2F, the discombobulated runoff water 46 continues from the inlet 18 to the outlet 20 and comes into contact with a second baffle 34 of the upwardly extending baffles 28. A portion of the runoff water 46 is allowed to pass through gullets 36 in the second baffle 34. Some of the runoff water 46 is again deflected in an upwardly direction by teeth 38 on the second baffle 34. A portion of the runoff water 46 deflected in an upwardly direction is again deflected in a downwardly direction toward the runoff water 46 passing at, near, or along the bottom wall 26. For example, some of the runoff water 46 is deflected backwards upon the runoff water 46 traveling at, near, or along the bottom wall 26 using the top wall 24 of the body 16. Other portions of the runoff water 46 may be deflected forward using the top wall 24. The forward deflected portion of the runoff water 46 is directed back into the runoff water 46 passing at, near or along the bottom wall 26 to cause the runoff water to be discombobulated, slowed and interrupted in its progression. As the runoff water 46 passes by the second baffle 28, it continues forward toward the outlet 20. Positioned on the outlet 20 is second baffle 66 of the downwardly extending baffles 30. The second baffle 66 is biased toward the bottom wall 26. The second baffle 66 causes the runoff water 46 to be spread across the bottom wall 26 before exiting the outlet 20. Moreover, because the second baffle 66 is biased toward the bottom wall 26, it further slows the runoff water 46 before exiting the body 16.

In addition to the discombobulation, absorption of energy, slowing and disruption of runoff water 46 caused by the upwardly extending baffles 28 and the downwardly extending baffles 30, the runoff water is diffused as it travels from the inlet 18 toward the outlet 20. Diffusion is caused by the tapering height and expanding width of the body 16 from the inlet 18 to the outlet 20. In addition, ribs 40 encourage runoff water 46 to spread outwardly within the body 16 further diffusing the runoff water 46. Thus, the runoff water 46 enters the body 16 near the inlet 18 having a runoff cross-section akin to the cross-section of the down spout 12. The cross-section of the runoff water 46 passing from the down spout 12 is diffused by spreading the runoff water 46 across a greater area while passing from the inlet 18 to the outlet 20.

Figure 5:
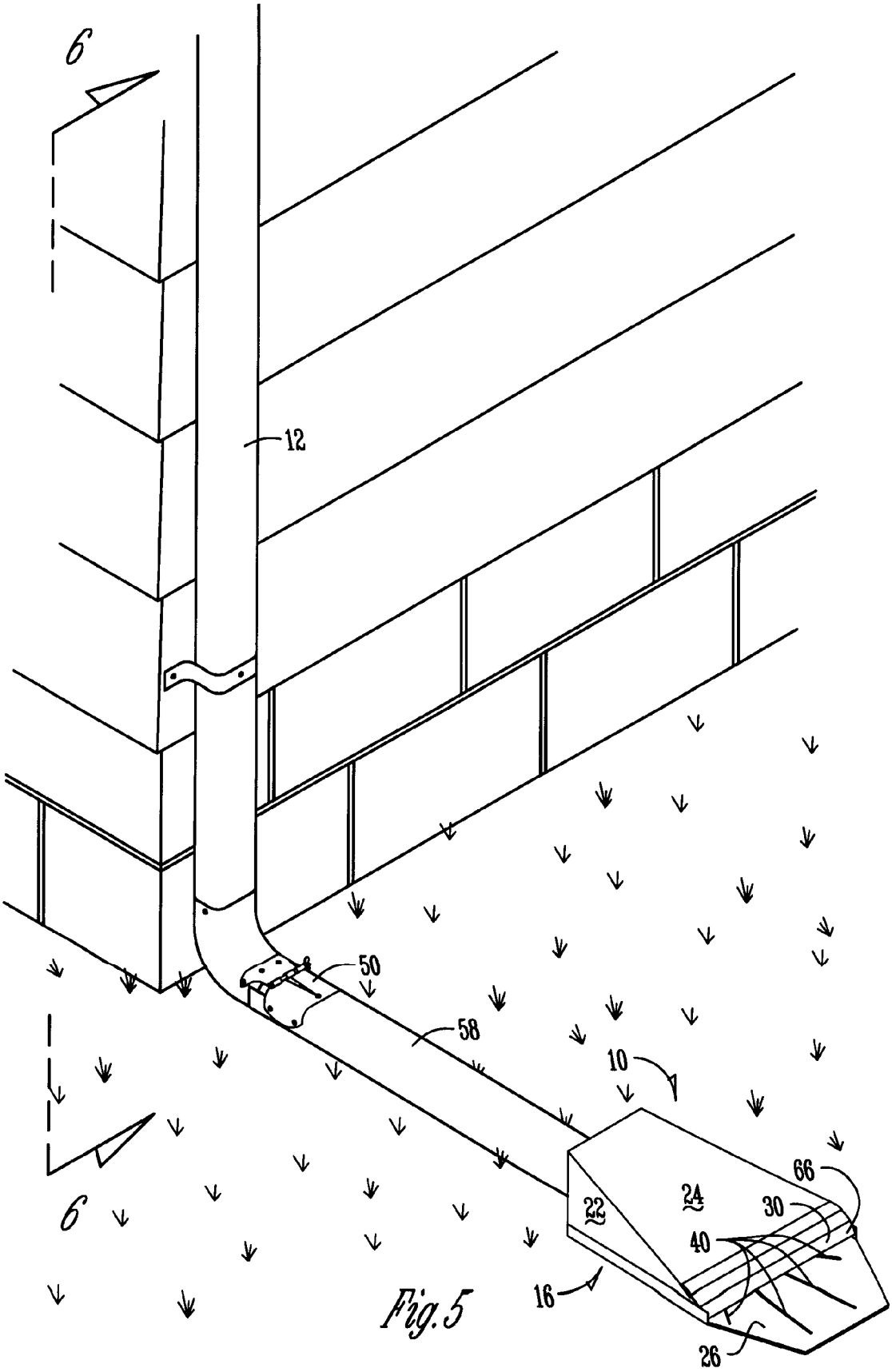
FIG. 5 is an isometric view of the apparatus hinged to the downspout according to an exemplary embodiment of the present invention.
Figure 6:
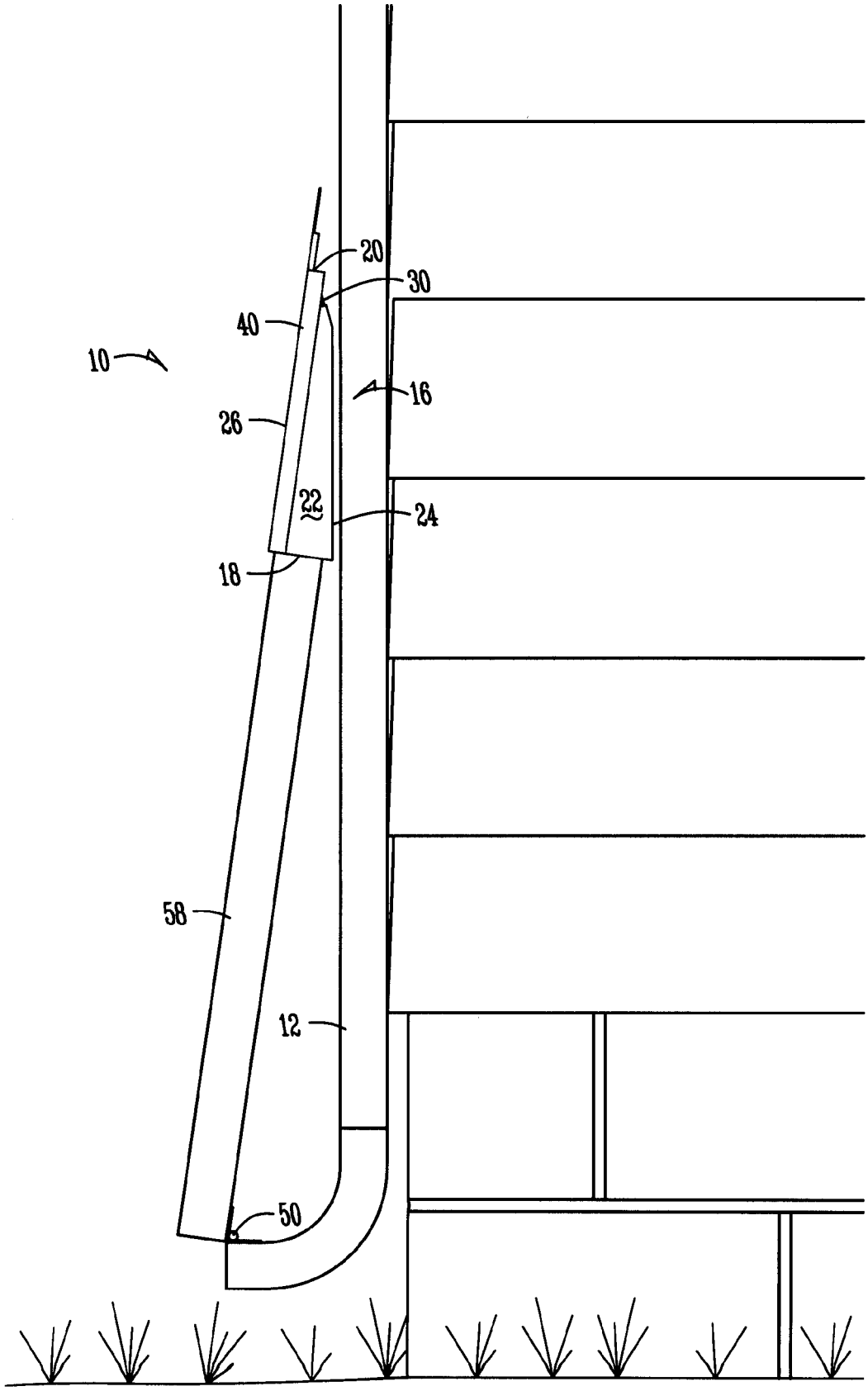
FIG. 6 is a side view of the apparatus flipped upward against the downspout according to an exemplary embodiment of the present invention.

Thus, the apparatus 10 has the ultimate effect of slowing, disrupting, absorbing energy from, and diffusing runoff water 46 having a potentially significant amount of energy and eroding capability before passing the runoff water 46 over the surrounding landscaping. In addition, the tapering height of the top wall 24 of the body 16 from the inlet 18 to the outlet 20 allows the apparatus 10 to rest flush against the down spout 12 when rotated upward using the hinge 50 as shown in FIGS. 5 and 6. Further, the apparatus 10 may be rotated upward out of the way, when necessary, to manicure or care for surrounding landscaping.

Figure 3A:
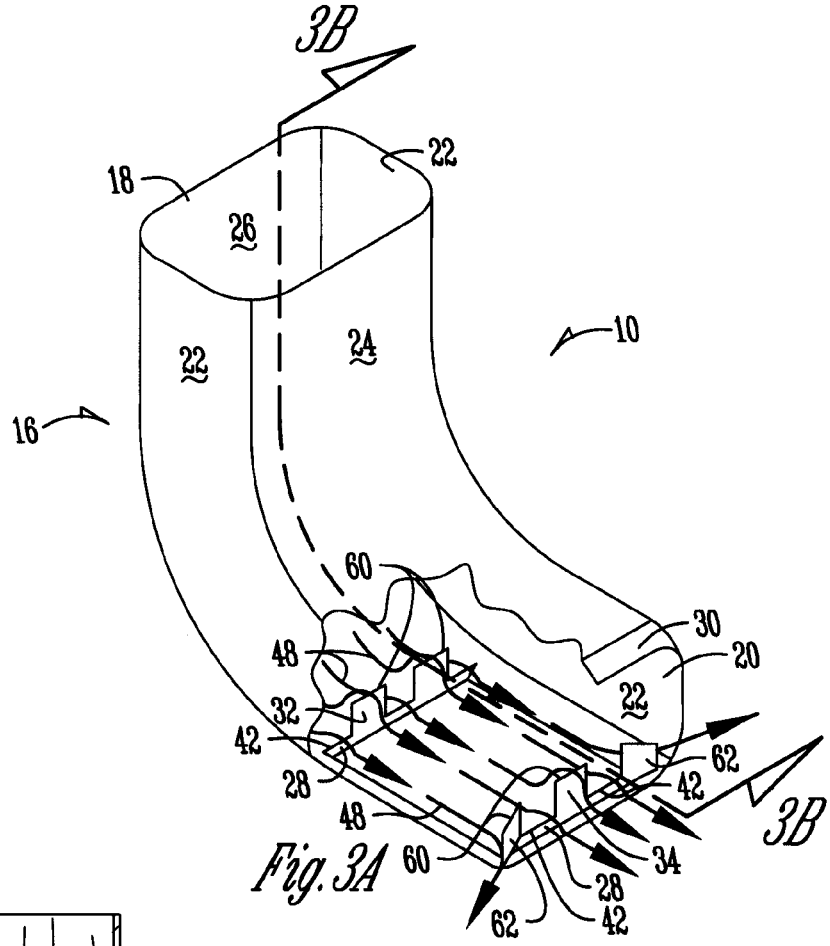
FIG. 3A is an isometric view of another embodiment of the present invention.
Figure 3B:
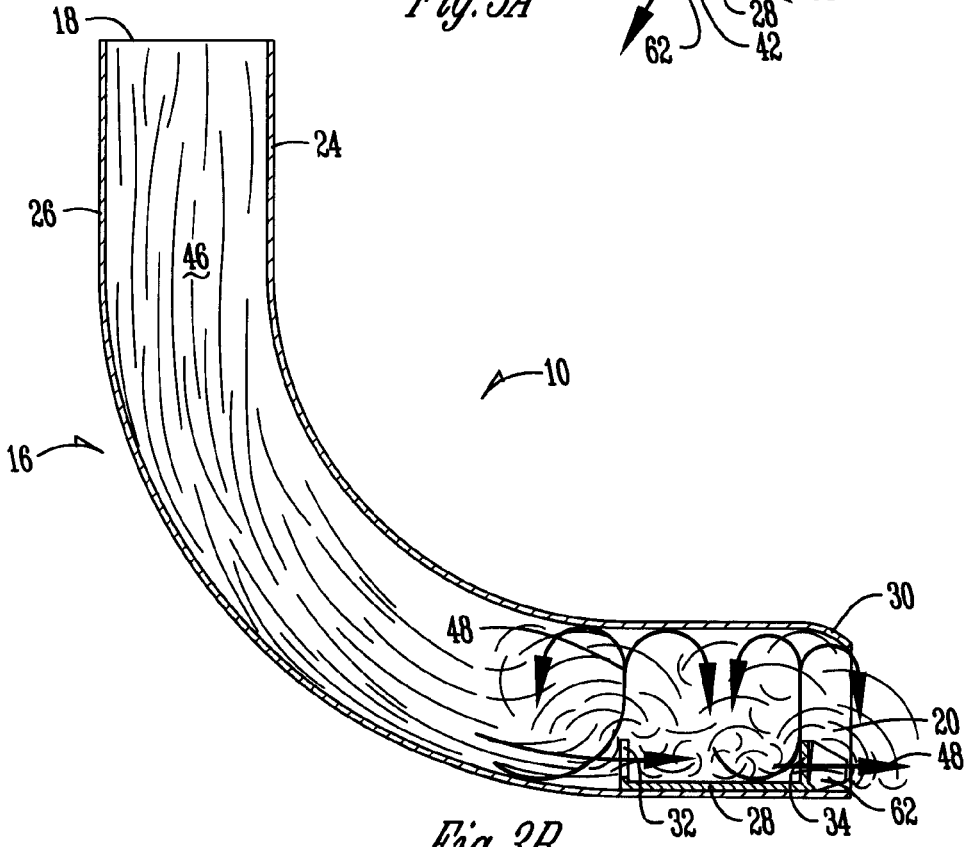
FIG. 3B is a cross-sectional view taken along line 3B-3B in FIG. 3A showing runoff water passing through the apparatus.

FIGS. 3A and 3B show another embodiment of the apparatus 10. FIG. 3A shows that the apparatus 10 has a body 16 of a gutter elbow. The inlet side 18 attaches to the down spout 12. The body 16 is defined by a top wall 24 connected to sidewalls 22 and enclosed by bottom wall 26. Positioned on the bottom wall 26 is a first baffle 32 and second baffle 34 of the upwardly extending baffles 28. The first baffle 32 is formed by teeth 32 spaced apart by gullet 36. The top planar edge 60 of each tooth 38 of the first baffle 32 is parallel with the bottom planar surface 42 of each gullet 36. Similar to the first baffle 32, the second baffle 34 has teeth 38 spaced apart by gullets 36. The second baffle 34 has angled teeth 62 positioned on the outermost portions of the second baffle 34. The angled teeth 62 are angled in an outwardly direction toward the sidewalls 22 of the body 16. A downwardly extending baffle 30 is positioned on the outlet 20 on the top wall 24 of the body 16. The downwardly extending baffle 30 is formed preferably by bending down the top wall 24 of the body 16 toward the bottom wall 26. The angle of bend for the angled teeth 62 on the second baffle 34 and downwardly extending baffle 30 may be altered to control the flow dynamics of runoff water 46 passing through the body 16.

In use, runoff water 46 passes from the inlet 18 through the body 16 of the apparatus 10 out the outlet 20 as shown in FIG. 3B. As runoff water 46 comes into contact with the first baffle 32, a portion of the runoff water 46 is allowed to pass through each gullet 36 and some of the runoff water 46 is deflected in an upwardly direction against the top wall 24 as shown by flow arrow 48. The runoff water 46 deflected upward by teeth 38 is thrown back down upon the runoff water 46 passing at, near or along the bottom wall 26 to thereby discombobulate, disrupt and slow the progression of the runoff water 46 from the inlet 18 toward the outlet 20. Downstream from the first baffle 32, the runoff water 46 comes into contact with the second baffle 34 before exiting the body 16. A portion of the runoff water 46 passes through each gullet 36 and some of the runoff water 46 is deflected upwardly toward the top wall 24. A portion of the runoff water 46 deflected upwardly is deflected backwards upon runoff water 46 passing at, near or along the bottom wall 26. Other portions of the runoff water 46 deflected upwardly is deflected in a downwardly direction by the downwardly extending baffle 30 into runoff water 46 traveling at, near or along the bottom wall 26 to further discombobulate, slow and disrupt the flow of runoff water 46 from the outlet side 20. Some of the runoff water traveling by or near the sidewalls 22 is diffused in an outwardly direction away from the sidewalls at the outlet 20 by the angled teeth 62. Thus, the runoff water 46 is slowed in its progression and diffused and deprived of its destructive, eroding power before passing over top of the surrounding landscaping.

Figure 4:
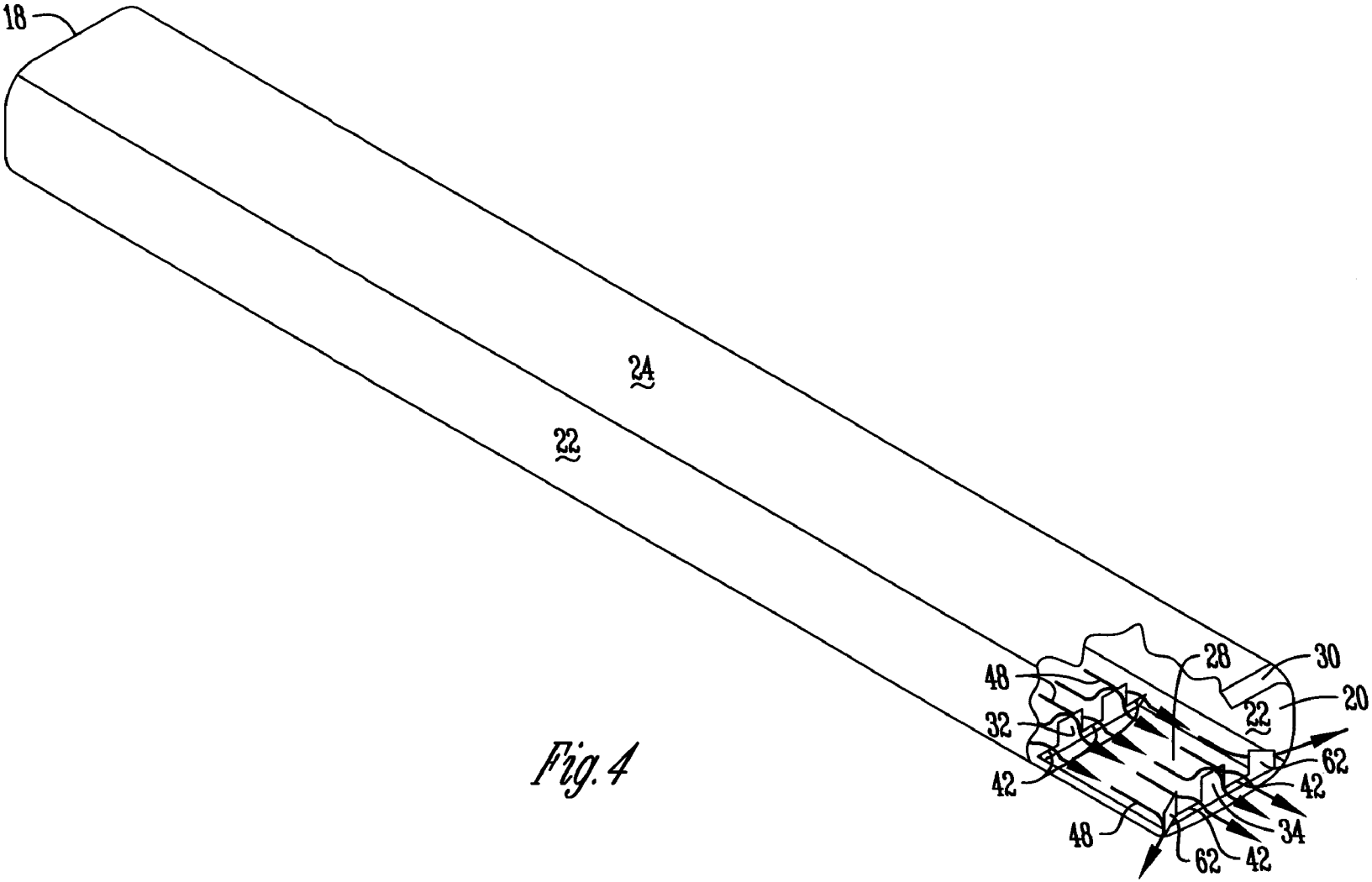
FIG. 4 is a cutaway view of another embodiment of the present invention.

FIG. 4 shows another embodiment of the apparatus 10. The body 16 is a gutter extension tube having a first baffle 32 and a second baffle 34 with a downwardly extending baffle 30. The operation of the first baffle 32 and second baffle 34 in addition to the downwardly extending baffle 30 is similar to the operation of the embodiment as discussed and shown in FIGS. 3A and 3B. For example, as shown in FIG. 4, some of the runoff water 46 is permitted to flow through each gullet 36 following the flow arrows 48. Other portions of the runoff water 46 are deflected upward and forced to flow over top of each tooth 38 on the first baffle 32 and second baffle 34. In addition, the downwardly extending baffle 30 forces runoff water back down upon itself to discombobulate and slow the progression of runoff water 46 from the outlet 20 across the surrounding landscaping. Again, like apparatus 10 in FIGS. 3A and 3B, the angled teeth 62 help to diffuse runoff water 46 before passing from the outlet 20 onto the surrounding landscaping.

The preferred embodiment of this invention has been set forth in the drawings and specification and those specific terms are employed, these are used in the generically descriptive sense only and are not used for the purposes of limitation. Changes in the formed portion and parts as well as in the substitution of equivalents are contemplated as circumstances expressed are rendered expedient without department from the spirit and scope of the invention as further defined in the following claims.

What is claimed is:

1. An apparatus for connecting to a down spout of a gutter system to slow, disrupt and diffuse runoff water to thereby eliminate erosion and destruction of surrounding landscaping, the apparatus comprises:

a body with an inlet and an outlet formed by a pair of sidewalls spaced apart and enclosed by a top wall and a bottom wall;

at least one upwardly extending baffle on the bottom wall to deflect runoff water upward, the baffle terminating in a top edge between the top and bottom wall of the body;

at least one downwardly extending baffle on the top wall to deflect runoff water downward;

the at least one upwardly extending baffle consists of a first baffle spaced upstream from a second baffle;

a gullet in the first baffle aligned with a tooth of the second baffle to slow and disrupt runoff passing through the first baffle; and the combination of the at least one upwardly extending baffle and the at least one downwardly extending baffle for slowing, discombobulating and diffusing runoff from the downspout to discourage erosion of surrounding landscaping.

2. The apparatus of claim 1 wherein a plurality of ribs are spaced apart and fanned outward from the inlet toward the outlet on the bottom wall for diffusing and slowing runoff passing over the bottom wall.

3. The apparatus of claim 2 wherein the plurality of ribs direct runoff into contact with and extend through at least one upwardly extending baffle to slow and discombobulate runoff within the body.

4. The apparatus of claim 1 wherein outermost teeth of the at least one upwardly extending baffle near the outlet are angled outward toward the pair of sidewalls to diffuse and slow runoff water passing from the outlet.

5. The apparatus of claim 1 wherein the at least one downwardly extending baffle consists of a first baffle spaced upstream from a second baffle.

6. The apparatus of claim 5 wherein the first baffle is a rigid planar member extending downward from the top wall of the body and terminating before the bottom wall between the pair of sidewalls to deflect some runoff downward to slow and disrupt runoff exiting the body.

7. The apparatus of claim 6 wherein the second baffle is a rubber flap on the top wall at the outlet biased against the bottom wall of the body to slow, disrupt and evenly diffuse runoff water passing from the outlet.

8. The apparatus of claim 1 wherein an adapter fitting attaches to the body at the inlet to mate A-style and B-style down spouts to the inlet.

9. The apparatus of claim 1 wherein the body is hingedly connected to the down spout for rotating the body upward out of the way so that the top wall rests flush against the downspout in a stowed position.

10. An apparatus for connecting to a down spout of a gutter system to discombobulate, slow, and diffuse runoff water to thereby eliminate erosion and destruction of surrounding landscaping, the apparatus comprises:

a body for passing runoff water through from the downspout;

at least one downwardly extending baffle on the top wall to deflect runoff water downward;

the combination of at least one upwardly extending baffle and the at least one downwardly extending baffle for slowing, discombobulating and diffusing runoff from the downspout to discourage erosion of surrounding landscaping;

wherein the body has an inlet and an outlet and a pair of sidewalls spaced apart and enclosed by a top wall and a bottom wall, the at least one baffle having a terminal edge spaced generally between and parallel to the top and bottom wall; and wherein the at least one upwardly extending baffle is a pair of upwardly extending baffles offset from each other so a gullet formed in one of the baffles is aligned with a tooth of the other baffle to disrupt runoff water flowing through the body.

11. The apparatus of claim 10 wherein a plurality of ribs extend upward from the bottom wall to a height less than the terminal edge of the at least one baffle, the ribs are spaced apart and fanned outward from the inlet to the outlet on the bottom wall to diffuse runoff water passing over the bottom wall.

12. The apparatus of claim 10 wherein one of the at least one baffle is a rubber flap positioned at the outlet on the top wall and biased against the bottom wall to slow and evenly diffuse runoff water exiting the body.

13. The apparatus of claim 10 wherein the at least one baffle comprises a rigid planar member extending between the pair of sidewalls and separated from at least the top wall or bottom wall within the body to deflect some runoff water back upon itself to disrupt and discombobulate runoff water passing through the body.

14. A method for preventing runoff water from a down spout of a gutter system from eroding surrounding landscaping, the method comprising:

providing a body for passing runoff water through from the downspout having an outlet and an inlet defined by a pair of opposite sidewalls spaced apart by a top member and enclosed by a base member, at least one upwardly extending baffle within the body attached to the base member and separated from the top member by a terminal edge, and at least one downwardly extending baffle attached to the top member and separated from the base member;

deflecting runoff water upward over the terminal edge between the baffle and top member using the at least one upwardly extending baffle and downward using the at least one downwardly extending baffle;

slowing runoff water while passing through the body by discombobulating runoff water within the body to prevent runoff water from eroding surrounding landscaping; and diffusing runoff water by fanning at least one pair of teeth on the at least one upwardly extending baffle outward toward the pair of opposite sidewalls and in a generally vertical plane to the base member.

15. The method of claim 14 further comprising the step of controlling runoff flowing from the outlet using one of the downwardly extending baffles positioned on the top member at the outlet, separated from the base member and biased toward the base member.

16. A method for preventing runoff water from a down spout of a gutter system from eroding surrounding landscaping, the method comprising:

providing an enclosure for passing runoff water through from the downspout, the enclosure having at least one upwardly extending baffle on the bottom wall to deflect runoff water upward, the baffle terminating in a top edge between the top and bottom wall of the body, at least one downwardly extending baffle on the top wall to deflect runoff water downward, and the combination of at least one upwardly extending baffle and the at least one downwardly extending baffle, wherein the at least one upwardly extending baffle consists of a first baffle spaced upstream from a second baffle, and a gullet in the first baffle aligned with a tooth of the second baffle to slow and disrupt runoff passing through the first baffle;

interrupting flow through the enclosure by passing at least some of the runoff water through at least one gullet in the first baffle and into at least one tooth of the second baffle; and discombobulating and slowing runoff water within the enclosure using the at least one baffle to prevent runoff water exiting the enclosure from eroding surrounding landscaping.

17. The method of claim 16 further comprising the step of redirecting runoff water back upon itself using the at least one baffle to discombobulate and slow runoff water passing through the enclosure.

18. The method of claim 16 further comprising providing a downwardly extending baffle attached at an outlet of the enclosure to slow, disrupt and evenly diffuse runoff water while passing out of the enclosure.

19. The method of claim 16 wherein the at least one baffle consists of a pair of upwardly extending baffles attached within the enclosure to slow and disrupt runoff water passing through the body.

* * * * *